US009783919B2

(12) United States Patent
Dendoncker et al.

(10) Patent No.: US 9,783,919 B2
(45) Date of Patent: Oct. 10, 2017

(54) WASHING DRUM

(71) Applicant: WERKHUIZEN LAPAUW NV, Kortrijk (BE)

(72) Inventors: Charles-Edouard Dendoncker, Orroir (BE); Niels Lehouck, Koksijde (BE)

(73) Assignee: WERKHUIZEN LAPAUW NV, Kortrijk (BE)

( * ) Notice: Subject to any disclaimer, the term of this patent is extended or adjusted under 35 U.S.C. 154(b) by 0 days.

(21) Appl. No.: 14/899,537

(22) PCT Filed: Jun. 16, 2014

(86) PCT No.: PCT/IB2014/062263

§ 371 (c)(1),
(2) Date: Dec. 17, 2015

(87) PCT Pub. No.: WO2014/203147

PCT Pub. Date: Dec. 24, 2014

(65) Prior Publication Data

US 2016/0222570 A1 Aug. 4, 2016

(30) Foreign Application Priority Data

Jun. 17, 2013 (BE) ..... 2013/0422

(51) Int. Cl.
*D06F 37/10* (2006.01)
*D06F 58/04* (2006.01)

(52) U.S. Cl.
CPC ..... *D06F 37/10* (2013.01); *D06F 58/04* (2013.01)

(58) Field of Classification Search
CPC ..... F26B 21/00; F26B 21/06; D06F 58/00; D06F 58/12; D06F 37/10
(Continued)

(56) References Cited

U.S. PATENT DOCUMENTS 3,158,707 A * 11/1964 Files ..... D06F 37/10 200/61.64
3,452,803 A * 7/1969 Stelwagen ..... D06F 37/10 160/213
(Continued)

FOREIGN PATENT DOCUMENTS

BE WO 2014203147 A3 * 4/2015 ..... D06F 37/10
DE 90 15 678 U 2/1991
(Continued)

OTHER PUBLICATIONS

International Search Report dated Feb. 5, 2015.

*Primary Examiner* — Stephen M Gravini
(74) *Attorney, Agent, or Firm* — Symbus Law Group, LLC; Clifford D. Hyra

(57) ABSTRACT

A washing drum (1) having an opening (4) in its cylindrical wall (3) and two door leaves (5, 6) which are arranged articulately between a first position, in order to close off the opening (4), and a second position, in order to free up the opening (4), wherein the first door leaf (5) has lugs (10) and the second door leaf (6) has hooks (9), which in the first position hook together, and having at least one resilient element (11), between a lateral side of the second door leaf (6) and the casing (3) laterally adjoining the opening (4), which resilient element (11) in the first position applies to the second door leaf (6) a spring force, towards the second position.

16 Claims, 5 Drawing Sheets

(58) Field of Classification Search
USPC ..... 34/108, 595, 610; 68/5 C, 5 R
See application file for complete search history.

(56) References Cited

U.S. PATENT DOCUMENTS

| | | | | | |
|---|---|---|---|---|---|
| 3,780,545 | A * | 12/1973 | Henderson | D06F 37/10 | 68/139 |
| 6,233,981 | B1 * | 5/2001 | Grandpierre | D06F 37/10 | 68/140 |
| 7,013,682 | B2 * | 3/2006 | Sharrow | D06F 37/10 | 68/12.26 |
| 7,937,974 | B2 * | 5/2011 | Kim | D06F 37/10 | 34/602 |
| 8,627,580 | B2 * | 1/2014 | Kim | D06F 37/02 | 34/601 |
| 9,145,635 | B2 * | 9/2015 | Woo | D06F 37/28 | |
| 9,175,432 | B2 * | 11/2015 | Del Pos | D06F 39/125 | |
| 9,290,972 | B2 * | 3/2016 | Tarr | E05C 19/16 | |
| 2016/0222570 | A1 * | 8/2016 | Dendoncker | D06F 58/04 | |
| 2016/0369445 | A1 * | 12/2016 | Kim | D06F 39/14 | |

FOREIGN PATENT DOCUMENTS

| | | | | |
|---|---|---|---|---|
| EP | 0 091 668 | A2 | 10/1983 | |
| EP | 0 133 302 | A2 | 2/1985 | |
| EP | 1574611 | A1 * | 9/2005 | D06F 37/10 |
| EP | 2 381 025 | A | 10/2011 | |
| FR | 1 117 944 | A | 5/1956 | |
| FR | 2 442 292 | A1 | 6/1980 | |
| GB | 2043704 | A * | 10/1980 | D06F 37/10 |
| KR | 20140098956 | A * | 8/2014 | |

* cited by examiner

WASHING DRUM

This application claims the benefit of Belgian patent Application No. 2013/0422, filed Jun. 17, 2013, which is hereby incorporated by reference in its entirety.

FIELD OF THE INVENTION

The present invention relates to a washing drum which is of substantially cylindrical construction and is arranged rotatably about its axis, comprising an opening in its casing and comprising a first door leaf and a second door leaf, which are each arranged articulately about a respective hinge pin between a first position (closed position), in which the door leaves together close off the opening, and a second position (open position), in which the door leaves free up the opening, wherein the hinge pins are arranged virtually parallel to the axis of the cylinder on a respective side of the opening, wherein the first door leaf, on its side opposite the side of the respective hinge pin, comprises lugs and the second door leaf, on its side opposite the side of the respective hinge pin, comprises hooks, wherein in the first position the hooks of the second door leaf hook into the lugs of the first door leaf, and wherein the washing drum comprises at least one resilient element, which in the first position applies to the second door leaf a spring force which drives the second door leaf into the second position.

BACKGROUND

Washing drums of this type can be rotatably arranged in, for example, a washing machine for the washing of articles or in a tumble dryer for the drying of articles. More specifically, the said articles can be laundry, for example.

These washing drums need to be provided with an opening for the placement of the articles into the washing drum or the retrieval of the articles from of this washing drum. A problem herein is that this opening has to be able to be closed with a door, during the washing and/or drying, without this door being able to come open, upon rotation of the washing drum, under the influence of the centrifugal forces acting on this door. On the other hand, this door still has to be able to be easily opened and closed again.

In the type of washing drums to which the present invention relates, the opening for loading and unloading of the washing drum is provided in the casing and two door leaves are provided to close off this opening. These door leaves are provided with hooks and lugs in order to be able to hook together the door leaves. The door leaves have to be moved towards the inner side of the washing drum in order to be unhooked again and can afterwards be opened towards outside the drum.

In washing drums of this type, it is difficult to be able to reconcile the conflicting requirements of, on the one hand, being easily able to open and close these washing drums for the loading and unloading thereof and, on the other hand, preventing these washing drums from being able to be accidentally reopened during operation.

In domestic applications, a number of solutions have already been devised for keeping these washing drums more securely closed during operation thereof and for nevertheless being easily able to open and close these same for loading and unloading thereof. Similar washing drums which are more suited to domestic applications are known, for example, from FR 2 819 272 A1, FR 2 862 317 A1, FR 2 289 659 A1, FR 2 730 249 A1, DE 22 65 551 B1, DE 200 07 903 U1, EP 0 402 252 A1, EP 2 415 924 A1, EP 0 091 668 A1 and EP 2 381 025 A1. The washing drums which are herein described all comprise all of the characteristics from the introductory part of the first claim. In order to prevent the door leaves from being able to be unhooked during the washing, resilient elements, which in the closed position of the door leaves apply a spring force to the door leaves towards their open position, are provided. In order to unhook the door leaves, it is necessary to move the door leaves counter to this spring force in towards the inner side of the drum. These resilient elements also deliver to the door leaves the kinetic energy necessary to be more easily able to open a relatively heavy door leaf after having been unhooked.

The solutions which are herein used to reconcile the abovementioned conflicting requirements are insufficiently robust. however, to be able to be used in non-domestic applications.

The present invention relates more specifically—but not restrictively—to washing drums for use in non-domestic applications. By this are understood washing drums in which loads from 40 kg-50 kg to as much as 100 kg-300 kg are normal. In domestic applications, loads are generally limited to weights somewhere between 5 kg and 10 kg.

In heavier loads of this type, which are common in non-domestic applications, considerable centrifugal forces, which act on the door leaves, are generated during rotation of the washing drum. The solutions from the domestic applications for keeping the door leaves closed during rotation, and for nevertheless being easily able to open them, prove to be insufficiently robust given such considerable centrifugal forces. The used resilient elements cannot generally deliver the spring force necessary to be able to keep the door leaves sufficiently securely closed during operation. The rather fragile locking systems which are used in domestic applications in order to nevertheless be more easily able to open these door leaves are again in this case no match for such heavier centrifugal forces. In washing drums for non-domestic applications, a stronger locking mechanism for the door leaves, as described, for example, in DE 90 15 678 U1, is hence generally employed. A strong locking mechanism of this type ensures, however, that the opening of the door leaves is quite laborious. In washing drums of this type for non-domestic applications, it is also known to split the door leaves into parts which must be opened separately, side by side, in order to be able to unload the washing drum, and which must also be closed separately, side by side, before the washing drum can be set in operation. Here too, the opening and/or closing of the washing drum is quite laborious. The known solutions for non-domestic applications are consequently characterized by a quite laborious way of opening and closing the drum for the loading and unloading thereof.

SUMMARY

It is consequently an object of the present invention to provide a washing drum which can be securely closed during operation thereof, which can nevertheless be easily opened and closed in order to load and/or unload the drum, and which more specifically—but not restrictively—is also suitable for non-domestic applications with washing drum loads in the order of magnitude of between 40 kg and 300 kg, and more specifically between 50 kg and 100 kg.

This object of the invention is achieved by providing a washing drum which is of substantially cylindrical construction and is arranged rotatably about its axis, comprising an opening in its casing and comprising a first door leaf and a second door leaf, which are each arranged articulately about a respective hinge pin between a first position, in which the door leaves together close off the opening, and a second position, in which the door leaves free up the opening, wherein the hinge pins are arranged virtually parallel to the axis of the cylinder on a respective side of the opening, wherein the first door leaf, on its side opposite the side of the respective hinge pin, comprises lugs and the second door leaf, on its side opposite the side of the respective hinge pin, comprises hooks, wherein in the first position the hooks of the second door leaf hook into the lugs of the first door leaf, wherein the washing drum comprises at least one resilient element, which in the first position applies to the second door leaf a spring force which drives the second door leaf into the second position, wherein in the first position of the door leaves their lateral sides corresponding to lateral parts of the casing which adjoin the lateral sides of the opening overlap, and wherein the resilient element is arranged between a lateral side of the second door leaf and the corresponding lateral part of the casing which laterally adjoins the opening.

Through displacement of the resilient element, this resilient element can now be made sufficiently robust to deliver the spring force necessary to keep hooked-together door leaves in their closed position during rotation of the washing drum. With the known positioning of resilient elements for the cushioning of the door leaves, this was not possible.

Preferably, in a washing drum according to the present invention, the resilient element is fastened to the drum. Preferably, as few as possible protruding elements are namely provided on the inner side of the door leaves in order to prevent a situation in which, in the loading and unloading of laundry, for example, this laundry catches behind these protruding elements and gets damaged.

In a specific embodiment of a washing drum according to the present invention, the resilient element is realized as a helical spring. With a helical spring of this type as the resilient element, a particularly robust embodiment can be produced.

In a washing drum according to the present invention, a possible further locking of the door leaves can in principle be omitted, but where this is however desired, for example because of safety reasons in respect of unlocking, the said door leaves can be realized in a manner which ensures that they can be opened and/or closed more easily, so that the door leaves can be opened and/or closed in a less laborious manner. Such a lock can then constitute an additional protection to prevent a situation in which, when the door leaves are unhitched, a door leaf springs open in an uncontrolled manner. In non-domestic applications for the washing of laundry, for example, where at least a part of the laundry weighing between 40 kg and 300 kg, and more specifically between 50 kg and 100 kg, after whirling thereof, remains stuck on the door leaves, a door leaf, when unlocked, could in fact be catapulted at particularly high force onto an operator who, for example, loses sight of the control over the door leaf. If the washing drum is operated according to the instructions, this should not happen, however. A lock thus serves merely as an additional protection. In a preferred embodiment of a washing drum according to the present invention, this washing drum consequently comprises a lock to lock the second door leaf in the first position.

Several types of locks can be considered for this purpose.

Preferably, a lock of this type, when locked, provides a temporary connection of the last-named lateral side of the second door leaf to the corresponding lateral part of the casing.

In a specific embodiment, in an embodiment of a washing drum according to the present invention of the type having a lock to lock the second door leaf in the first position, wherein, upon locking, a temporary connection of the lateral side of the second door leaf to the corresponding lateral part of the casing is realized, an upright pin is fastened to the last-named lateral part of the casing. The corresponding lateral side of the second door leaf then comprises a through opening for this pin, so that in the first position of the second door leaf the pin extends through this through opening. In the first position of the second door leaf, the said lock here engages on the free end of the pin in order to lock the second door leaf in the first position.

With the aid of such a pin, which extends through a through opening, a lock of this type can be robustly produced.

In particular, in an embodiment of this type, the free end of the pin can comprise a widening, and the lock can comprise a locking plate, which is arranged on the last-named lateral side of the second door leaf displace ably, in a direction according to the axis of the drum, between a locking position and an unlocking position, and which, towards the last-named lateral side of the second door leaf, comprises a recess, so that in the locking position the locking plate engages under the widening of the pin and the pin engages in the recess. A lock having such a locking plate, which engages under a widening of a pin, is a particularly simple embodiment of a robust lock.

In this way, a particularly robust embodiment is obtained of a washing machine according to the present invention, which, on the one hand, can be easily opened and closed and which, on the other hand, reliably ensures that the door leaves cannot come open during rotation of the washing drum.

In such an embodiment of a washing drum, having a lock which can engage on a pin which is fastened to one door leaf and extends through a through opening of the other door leaf, wherein the resilient element is realized as a helical spring, this helical spring is preferably placed around the pin, and a washer is placed between the helical spring and the second door leaf.

In an embodiment of this type, the through opening in the second door leaf preferably extends farther in a direction according to the circumference of the drum than in a direction according to the axis of the drum. In order to make the pin engage in the through opening during the rotational motion by which the second door leaf is closed, the through opening has to have a certain length in the direction according to the circumference of the drum. In order to make the helical spring, with the aid of the washer, engage as well as possible on the second door leaf, the through opening is then preferably again as small as possible. These conflicting requirements are reconciled with the aid of a through opening, the length of which in a direction according to the circumference of the drum is greater than the length in a direction according to the axis of the drum.

Other locks which, upon locking, can provide a temporary connection of the last-named lateral side of the second door leaf to the corresponding lateral part of the casing are also conceivable. Thus a bolt lock, for example, can be provided, the eye of which is provided, for example, on the relevant lateral part of the casing, in which eye the displaceable part of the bolt lock, provided on the lateral side of the second door leaf, can engage. The eye and the displaceable part can here also be made to swap places. It is also possible to provide a plurality of such bolt locks or a bolt lock whereof the displaceable part engages in a plurality of eyes at the same time, so that the lateral side of the door leaf is temporarily connected at several points to the corresponding lateral part of the casing.

Alternative locks which are not provided in a temporary connection of the last-named lateral side of the second door leaf to the corresponding lateral part of the casing, but are provided in an additional temporary mutual connection of the door leaves, are also conceivable. Thus it is possible, for example, to fasten a hook articulately to the second door leaf, which hook, upon locking, hooks over the first door leaf, in the other direction from the aforementioned hooks of the second door leaf. It is further possible, for example, to provide a displaceable element on the second door leaf, which element, upon locking, at least partially closes off under a spring force the opening of a said hook of the second door leaf—along which this hooks into a corresponding lug of the first door leaf—such that this hook cannot be unhooked. These alternatives are less preferred, since they can be made somewhat less robust than locks which provide a temporary connection of the last-named lateral side of the second door leaf to the corresponding lateral part of the casing. Moreover, these do not ensure an additional protection in the unhitching of the door leaves, since they have to be unlocked before the door leaves can be unhitched.

The last-named lateral side of the second door leaf of a washing drum according to the present invention preferably comprises a protruding tooth, under which the resilient element engages in the first position of the second door leaf. With the aid of such a protruding tooth, the door leaf is locally made wider where it is wished to make the resilient element engage on the door leaf. The weight of the door leaf does not significantly increase as a result of this.

The last-named lateral part of the drum preferably comprises a depression, into which the resilient element substantially extends in the first position of the second door leaf.

With a depression of this type, a relatively large gap can be created in a simple manner between the door leaf and the casing without this spacing becoming a nuisance. This gap is of importance in order to make the spring travel as large as possible so as to be able to apply sufficient spring force to the door leaf to be able to keep this in its closed position. If such a gap were to be provided over the complete lateral side, then either the volume of the drum would have to be reduced, whereby less articles could be simultaneously treated in the washing drum, or a greater distance between the washing drum and a fixed drum, in which such a washing drum is normally arranged, would have to be provided, resulting in a greater water consumption for a same treatment of articles. By providing the said depression, the second door leaf can butt fully against this lateral part next to this depression and only at the level of this depression remain at that distance from the door leaf which is necessary to be able to make the resilient element extend herebetween.

Moreover, owing to such a depression, there is less chance, for example, of laundry becoming stuck between the door leaf and the lateral part of the drum and getting damaged. At the level of this depression, a screening element (for example in the form of a plate-like element) can possibly be provided in order to close off the opening between the depression and the second door leaf in the first position of the second door leaf.

Preferably, a washing drum according to the present invention also has at least one resilient element which is arranged between the opposite lateral side of the second door leaf from the first-named resilient element and the corresponding lateral part of the casing which laterally adjoins the opening, which resilient element drives the second door leaf into the second position. In this way, the second door leaf can be symmetrically cushioned.

Further preferably, in a washing drum according to the present invention, between each lateral side of the first door leaf and the respective corresponding lateral part of the casing which adjoins the opening is also arranged at least one resilient element, which drives the first door leaf into the second position. Door leaves of non-domestic washing drums are quite heavy. When the first door leaf is opened, these resilient elements help to impart through the door leaf the kinetic energy necessary to be easily able to manually further open the first door leaf.

In order to prevent the first door leaf from undesirably springing open under the influence of this kinetic energy following unhooking of the door leaves, a washing drum of this type further preferably comprises a lock to lock the first door leaf in the first position. Thus an operator can first deliberately unlock the first door leaf and so help to have the imparted kinetic energy controlled in order to open the first door leaf.

Several types of locks can be considered for this purpose.

Preferably, a lock of this type, when locked, provides a temporary connection of a said lateral side of the first door leaf to the corresponding lateral part of the casing.

Preferably, in an embodiment of this type, an upright pin, having a widening at its free end, is fastened to that lateral part of the casing which in the first position is overlapped by a lateral side of the first door leaf. The corresponding lateral side of the first door leaf then comprises a through opening for this pin, so that in the first position of the first door leaf the pin extends through this through opening. The lock then preferably comprises a locking plate, which is arranged on the last-named lateral side of the first door leaf displaceably, in a direction according to the axis of the drum, between a locking position and an unlocking position, and which comprises a recess towards the last-named side of the first door leaf, so that in the locking position the locking plate engages under the widening of the pin and the pin engages in the recess.

The object of the present invention is also further achieved by providing a washing machine having a washing drum according to the present invention.

In addition, the object of the present invention is also achieved by providing a tumble dryer having a washing drum according to the present invention.

BRIEF DESCRIPTION OF THE DRAWINGS

The present invention is now more closely explained on the basis of the following detailed description of some preferred embodiments of washing drums according to the present invention. The aim of this description is to provide purely illustrative examples and to indicate further advantages and peculiarities of washing drums, and can thus not be interpreted as a limitation of the field of application of the invention or of the patent rights claimed in the claims.

In this detailed description, reference is made by means of reference numerals to the appended drawings, wherein.

DETAILED DESCRIPTION

Figure 1:
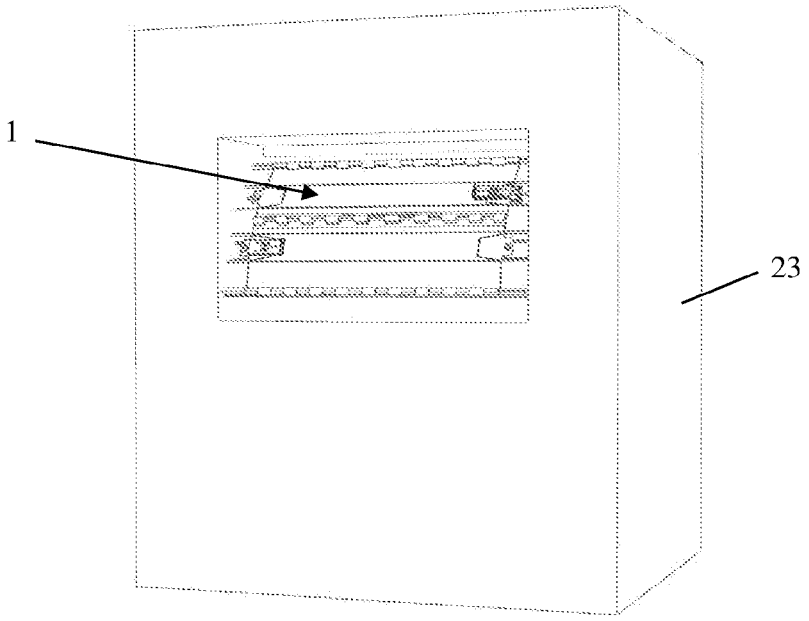
FIG. 1 represents an embodiment of a washing machine or tumble dryer according to the present invention in perspective view.

The shown washing drum (1) comprises a substantially cylindrical casing (3) having on both sides a side wall (22). Both the casing (3) and the side walls (22) are typically produced from metal plates, which are welded together. The casing (3) is normally provided with openings (for example by punching) for the delivery and discharge of water and/or steam in the drum (1) in order to wash and/or dry articles, such as laundry, placed herein. To this end, this washing drum (1) is further accommodated in a washing machine (23) or a tumble dryer (23), as can be seen in FIG. 1, in a fixedly arranged surrounding drum. The washing drum (1) is herein arranged rotatably about its axis (2). This axis (2) is normally not a real axis which extends through the drum (1). The drum (1) is suspended in bearing-mounted arrangement from the side walls (22), so that it is rotatable about a virtual axis (2).

Figure 13:
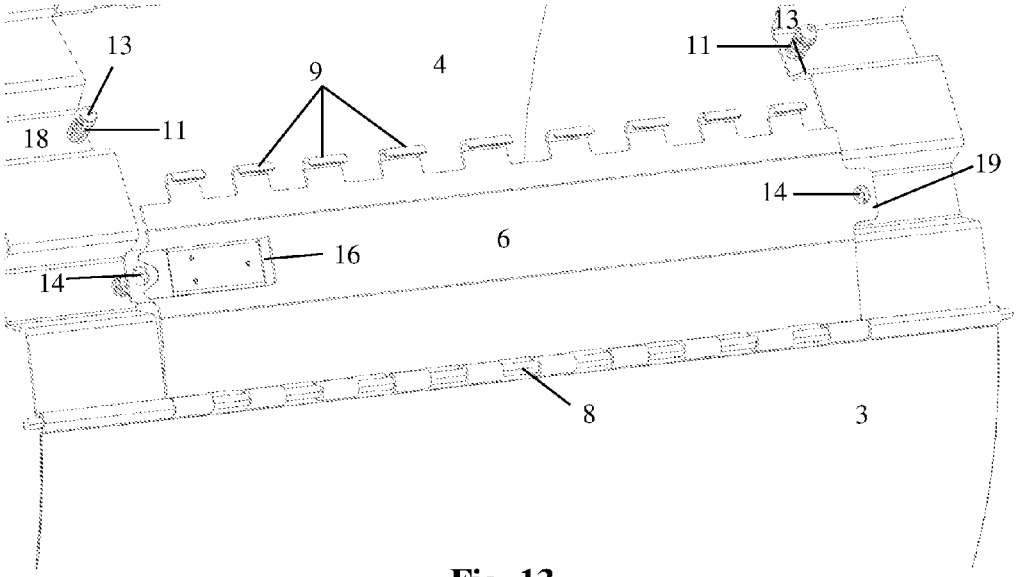
FIG. 13 shows a part of the washing drum from FIG. 2 at the level of the second door leaf in perspective view, with the first door leaf in the open position and the second door leaf unlocked.
Figure 14:
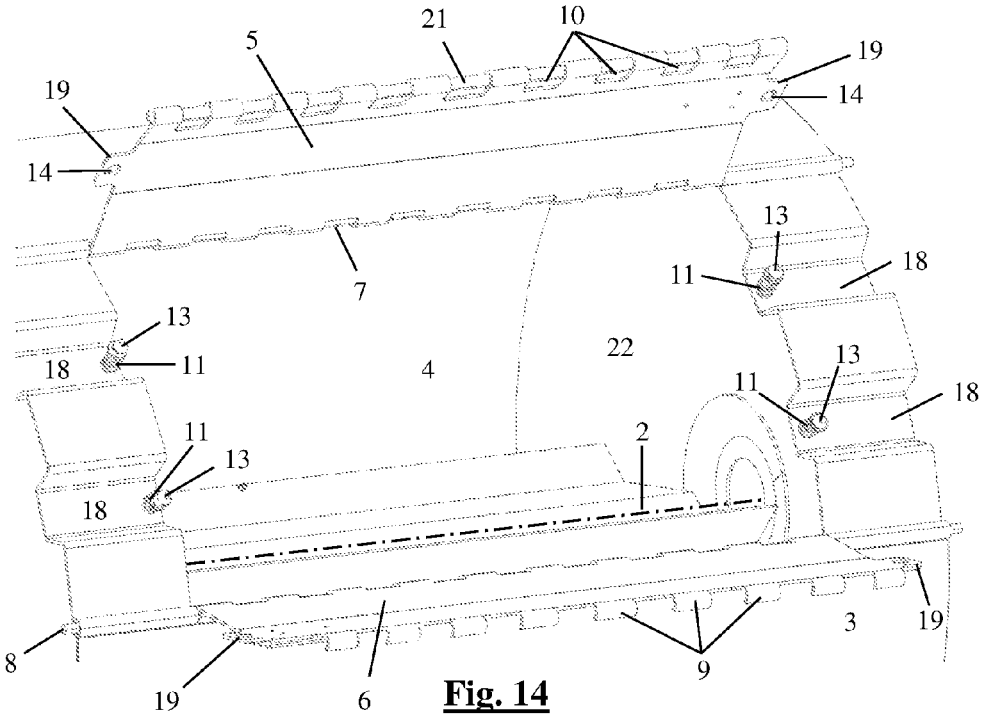
FIG. 14 shows the part of the washing drum from FIG. 8 in perspective view, with both door leaves in the open position.

In the casing (3) of the washing drum (1) is provided an opening (4) (see FIGS. 13 and 14). Via this opening (4), the articles to be washed and/or dried can be placed into the washing drum (1) and/or retrieved herefrom. This opening (4) can be closed off with the aid of two door leaves (5, 6). These door leaves (5, 6) are each arranged on an opposite side of the opening (4) articulately about a respective hinge pin (7, 8), which extends parallel to the axis (2) of the drum (1). In order to make the hinges robust, they are here formed by protruding teeth on the door leaves (5, 6) for folding and welding in place. Through these folded-over protruding teeth is placed a respective hinge pin (7, 8), which is further accommodated in a fold in the casing (3) and is placed through the side walls (22).

Figure 2:
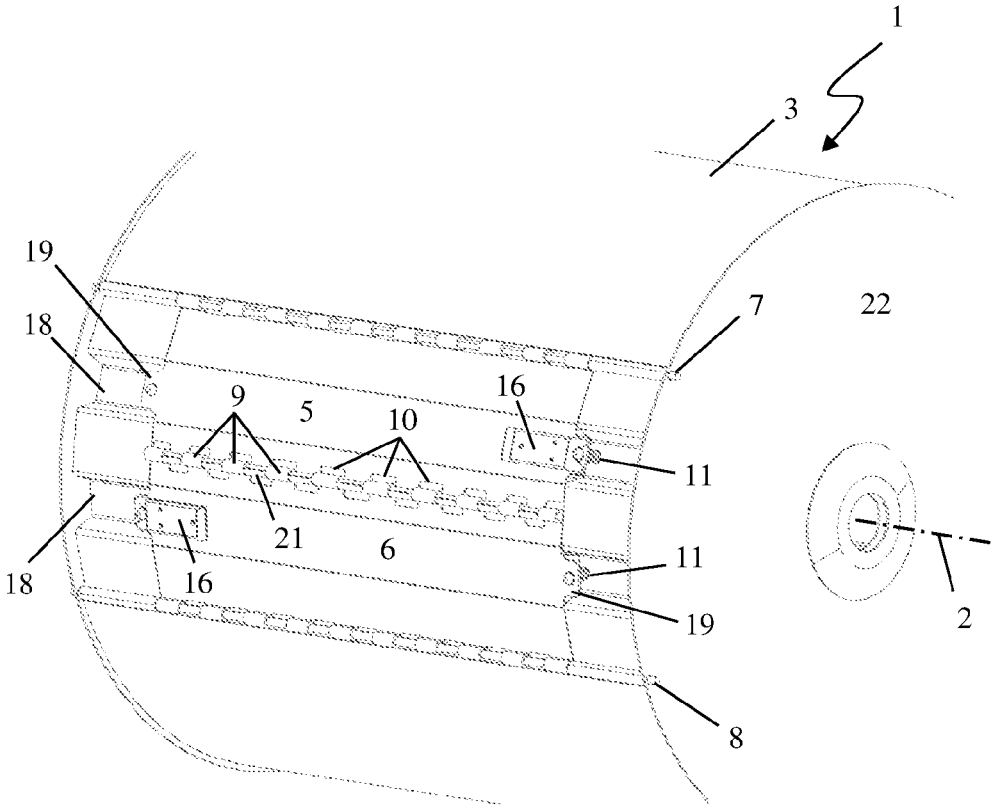
FIG. 2 shows a part of a washing drum according to the present invention in perspective view, with a view of the door leaves in their first position.
Figure 6:
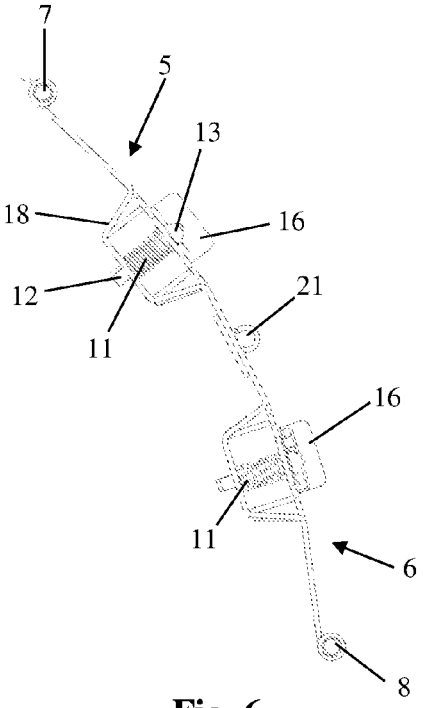
FIG. 6 shows a cross section of a part of the washing drum from FIG. 2 at the level of the door leaves, with the door leaves in the closed position.
Figure 12:
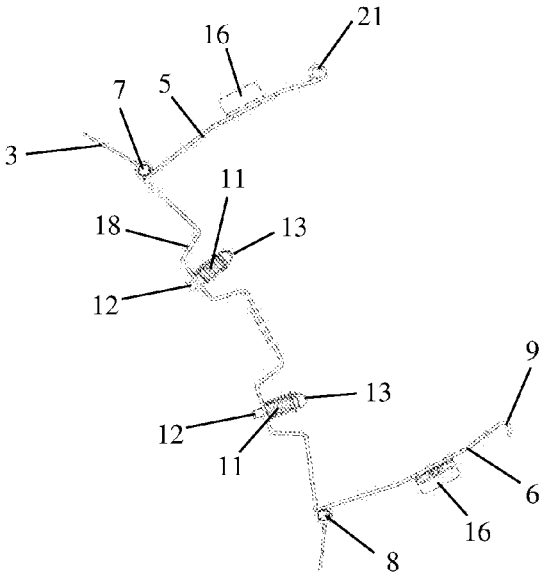
FIG. 12 shows the part of the washing drum from FIG. 6 in cross section, with both door leaves in the open position.

In FIGS. 2 and 6, the door leaves (5, 6) are shown in their closed position, wherein they together close off the opening (4). In FIGS. 12 and 14, the door leaves (5, 6) are shown in their open position, wherein they free up the opening (4).

In FIGS. 8-11 and 13, it is shown how the door leaves (5, 6) can be brought from their closed position into their open position.

The first shown door leaf (5), on its side opposite the side from which it is articulately suspended, is provided with lugs (10), this by folding over and welding of projecting teeth of the door leaf (5) and placement of a pin (21) herethrough. The second shown door leaf (6), on its side opposite the side from which it is articulately suspended, is provided with corresponding hooks (9), which are realized as folded-over protruding teeth of the door leaf (6). These hooks (9) can be hooked into the lugs (10) of the first door leaf (5). When both door leaves (5, 6) are in their closed position, the hooks (9) of the second door leaf (6) are hooked in the lugs (10) of the first door leaf (5), as can be seen in FIGS. 2 and 6.

Figure 7:
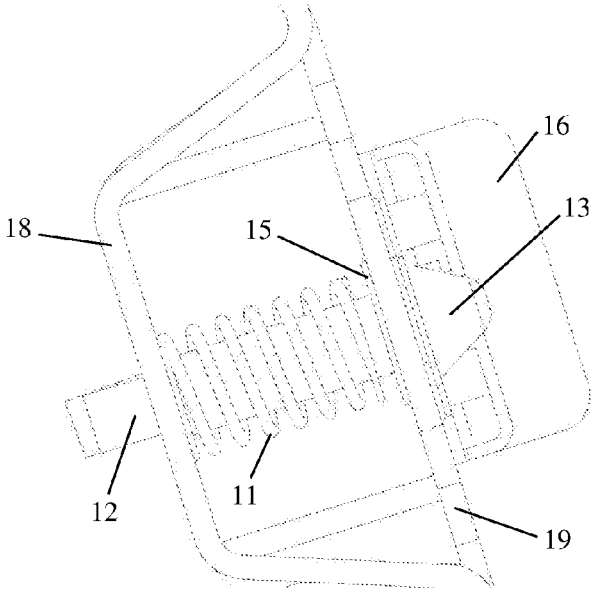
FIG. 7 shows a part of the cross section from FIG. 6 in more detail at the level of the locking mechanism pertaining to the second door leaf.
Figure 8:
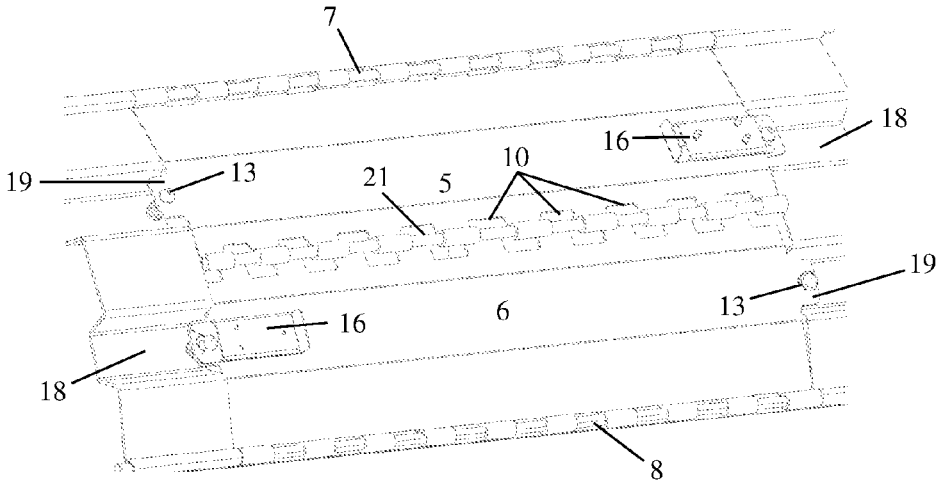
FIG. 8 shows a part of the washing drum from FIG. 2 at the level of the door leaves in perspective view, with the door leaves unhitched and the second door leaf in the locked position.
Figure 9:
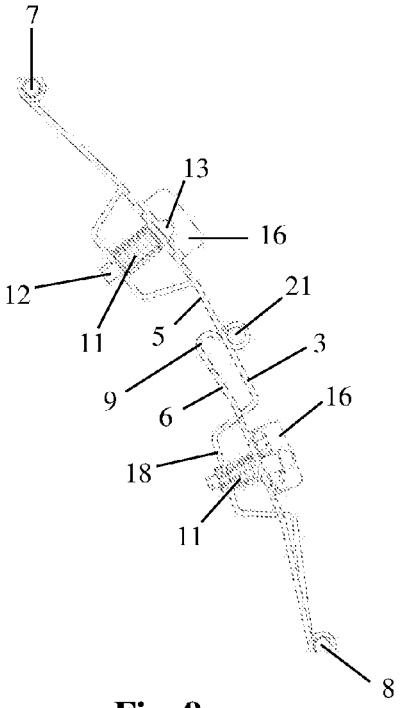
FIG. 9 shows the part of the washing drum from FIG. 6 in cross section, with the door leaves completely unhitched and the first door leaf in the closed position.
Figure 10:
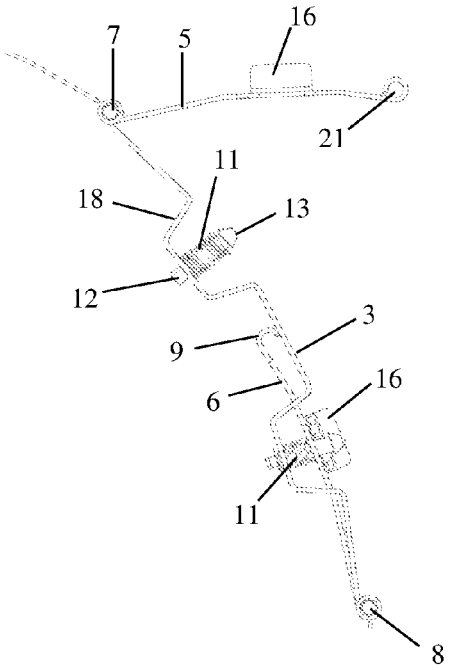
FIG. 10 shows the part of the washing drum from FIG. 6 in cross section, with the first door leaf in half-open position and the second door leaf still locked.
Figure 11:
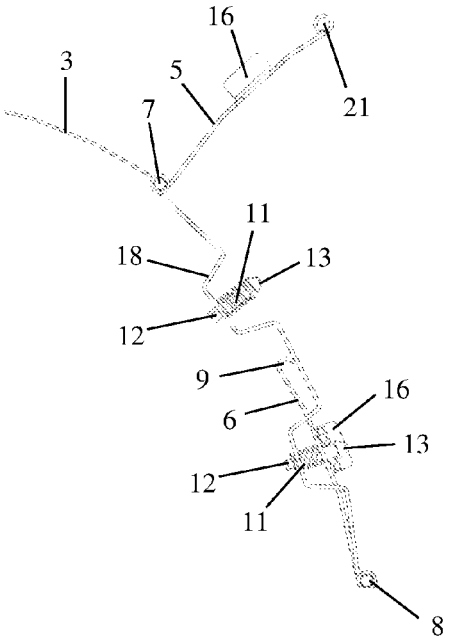
FIG. 11 shows the part of the washing drum from FIG. 6 in cross section, with the first door leaf in the open position and the second door leaf still locked.

In both door leaves (5, 6) there is provided for each lateral side a helical spring (11), which in the closed position of the door leaves (5, 6) applies a spring force to the corresponding door leaf (5, 6) towards its open position. The corresponding parts of the casing (3), which laterally adjoin the opening (4), are provided with corresponding depressions (18). This can be realized, for example, by suitable folding of a metal plate from which the casing is produced. In these depressions (18), corresponding pins (12) are fastened to the casing (3), which pins extend outwards relative to the casing surface (see FIG. 7). In the door leaves (5, 6) are provided corresponding through openings (14) (see FIG. 14), through which the pins (12) can extend when the door leaves (5, 6) are in their closed position. The helical springs (11) are placed around the corresponding pins (12) and between the helical springs (11) and the corresponding door leaves (5, 6) is respectively placed a washer (15), as can be seen more clearly in FIG. 7. The door leaves (5, 6) are respectively provided with protruding teeth (19) corresponding with the springs (11). Each resilient element (11) thus extends, in the closed position of the corresponding door leaf (5, 6), substantially into the corresponding depression (18), and this between the corresponding lateral part of the casing (3) adjoining the opening (4) and the corresponding protruding tooth (19) of the corresponding door leaf (5, 6).

The through openings (14) extend in a direction according to the circumference of the drum (1) farther than in a direction according to the axis (2) of the drum (1), so that the pins (12) can engage through the through opening upon rotation of the door leaves (5, 6).

Figure 3:
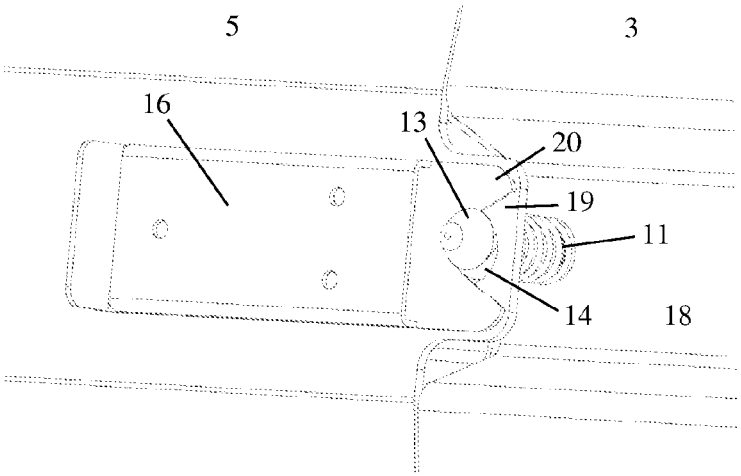
FIG. 3 shows the washing drum from FIG. 2 in more detail at the level of a resilient element and a lock in the locked position.
Figure 4:
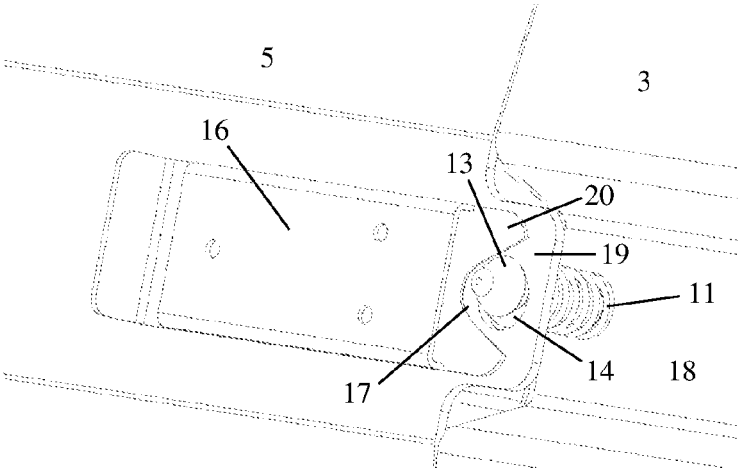
FIG. 4 shows the part of the washing drum from FIG. 3 in perspective view, with the lock in the unlocked position.
Figure 5:
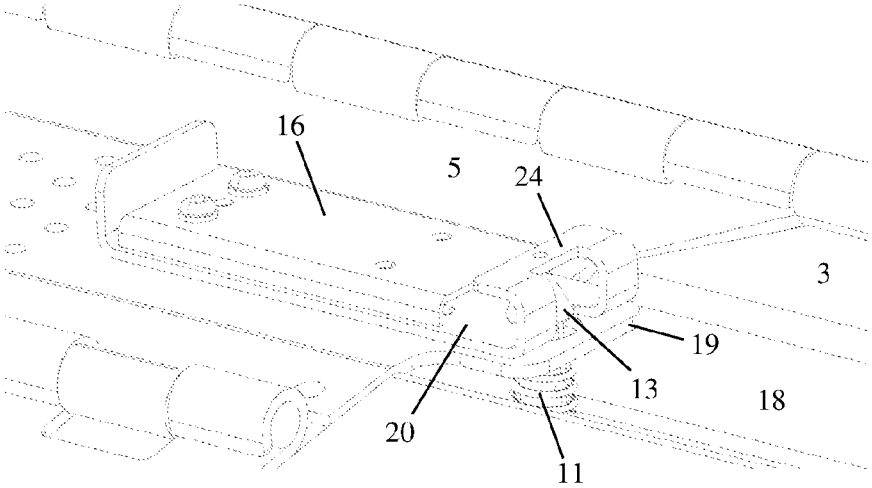
FIG. 5 shows an alternative lock for the washing drum from FIG. 2 in more detail in perspective view, in the locked position.

The pins (12) further comprise at their free end a widening (13). For each door leaf (5, 6) is arranged a lock (16), which can engage on these pins (12) under this widening (13). To this end, a locking plate (20) of the lock (16) is arranged displaceably, in a direction according to the axis of the drum (1), between a locking position (towards the corresponding pin (12), see FIG. 3) and an unlocking position (away from the corresponding pin (12), see FIG. 4). This can be realized, for example, by providing this locking plate (20) with an elongated guide slot in the sliding direction and by providing the corresponding door leaf (5, 6) with a guide pin, which can engage in this guide slot for the guidance of the sliding motion. This locking plate (20) comprises towards the corresponding pin (12) al recess (17), so that in the locking position the locking plate (20) engages under the widening (13) of the corresponding pin (12) and the pin (12) engages in the recess (17). On this side of the lock (16) can possibly also be provided on the locking plate (20), as in the embodiment from FIG. 5, an upward rising volute element (24), which in the locking position extends above the widening (13) of the pin (12). This volute element (24) then ensures that the door leaves (5, 6) are are not unlocked, during the rotation of the washing drum (1), by forces directed inwards into the drum (1).

In order to open the door leaves (5, 6), these need firstly to be pushed inwards counter to the spring force in order to unhook the door leaves (5, 6). After this, the first door leaf (5) is unlocked by displacement of the lock (16) away from the corresponding pin (12). The first door leaf (5) is completely unhooked and brought into its open position, as can be seen in FIGS. 8 to 11. To this end, the springs (11) impart to the first door leaf (5) kinetic energy, which further facilitates the manual opening of this door leaf (5). The lock (16) of the second door leaf (6) here ensures that the second door leaf (6), during opening of the first door leaf (5), does not have to be manually detained and cannot spring open in an uncontrolled manner. After this, the lock (16) of the second door leaf (6) is opened, as can be seen in FIG. 14, and the second door leaf (6) is brought into its open position, as can be seen in FIGS. 12 and 14. To this end, the springs (11) impart to the second door leaf (6) kinetic energy, which further facilitates the manual opening of this door leaf (6). For the closure of the door leaves (5, 6), the reverse procedure is adopted.

The invention claimed is:

1. Washing drum which is of substantially cylindrical construction and is arranged rotatably about an axis, comprising:

an opening in a casing; and a first door leaf and a second door leaf, which are each arranged articulately about a respective hinge pin between a first position, in which the first and second door leaves together close off the opening, and a second position, in which the first and second door leaves free up the opening;

wherein the respective hinge pins are arranged virtually parallel to the axis on a respective side of the opening;

wherein the first door leaf, on a side opposite a side of the respective hinge pin, comprises lugs and the second door leaf, on a side opposite a side of the respective hinge pin, comprises hooks;

wherein in the first position the hooks of the second door leaf hook hook into the lugs of the first door leaf;

wherein the washing drum comprises at least one resilient element, which in the first position applies to the second door leaf a spring force which drives the second door leaf into the second position;

wherein in the first position of the first and second door leaves lateral sides of the door leaves overlap with corresponding lateral parts of the casing which adjoin lateral sides of the opening; and wherein the resilient element is arranged between a lateral side of the second door leaf and the corresponding lateral part of the casing which laterally adjoins the opening.

2. Washing drum according to claim 1, characterized in that the resilient element is fastened to the drum.

3. Washing drum according to claim 1, characterized in that the resilient element is realized as a helical spring.

4. Washing drum according to claim 1, characterized in that the washing drum comprises a lock to lock the second door leaf in the first position.

5. Washing drum according to claim 4, characterized in that the lock, when locked, provides a temporary connection of the lateral side of the second door leaf to the corresponding lateral part of the casing.

6. Washing drum according to claim 5, characterized in that an upright pin is fastened to the corresponding lateral part of the casing, in that the corresponding lateral side of the second door leaf comprises a through opening for the upright pin, so that in the first position of the first and second door leaves the pin extends through this through opening, and in that the lock is provided to, in the first position of the first and second door leaves, engage on the free end of the pin in order to lock the second door leaf in the first position.

7. Washing drum according to claim 6, characterized in that the free end of the pin comprises a widening, and in that the lock comprises a locking plate, which is arranged on the last-named lateral side of the second door leaf displaceably, in a direction according to the axis of the drum, between a locking position and an unlocking position, and which, towards the last-named lateral side of the second door leaf, comprises a recess, so that in the locking position the locking plate engages under the widening of the pin and the pin engages in the recess.

8. Washing drum according to claim 6, characterized in that the helical spring is placed around the upright pin, and in that a washer is placed between the helical spring and the second door leaf.

9. Washing drum according to claim 7, characterized in that the through opening in the second door leaf extends farther in a direction according to a circumference of the drum than in a direction according to the axis.

10. Washing drum according to claim 1, characterized in that the last-named lateral side of the second door leaf comprises a protruding tooth, under which the resilient element engages in the first position of the first and second door leaves.

11. Washing drum according to claim 1, characterized in that a last-named lateral part of the drum comprises a depression, into which the resilient element substantially extends in the first position of the second door leaf.

12. Washing drum according to claim 1, characterized in that at least one additional resilient element is arranged between the opposite lateral side of the second door leaf from the resilient element and the corresponding lateral part of the casing which laterally adjoins the opening, which additional resilient element drives the second door leaf into the second position of the first and second door leaves.

13. Washing drum according to claim 1, characterized in that between each lateral side of the first door leaf and the respective corresponding lateral part of the casing which laterally adjoins the opening is arranged at least one resilient element, which drives the first door leaf into the second position.

14. Washing drum according to claim 13, characterized in that the washing drum comprises a lock to lock the first door leaf in the first position.

15. Washing machine comprising a washing drum according to claim 1.

16. Tumble dryer comprising a washing drum according to claim 1.

* * * * *